United States Patent [19]

Goldman

[11] Patent Number: 4,966,495

[45] Date of Patent: Oct. 30, 1990

[54] SEMISUBMERSIBLE VESSEL WITH CAPTURED CONSTANT TENSION BUOY

[76] Inventor: Jerome L. Goldman, 935 Gravier St., Suite 2100, New Orleans, La. 70112

[21] Appl. No.: 221,422

[22] Filed: Jul. 19, 1988

[51] Int. Cl.[5] ..... B63B 35/44

[52] U.S. Cl. ..... 405/224; 114/264; 175/5; 405/195

[58] Field of Search ..... 405/195, 224, 200, 211; 114/264, 265, 266; 166/350; 175/5, 7, 8

[56] References Cited

U.S. PATENT DOCUMENTS

| | | | |
|---|---|---|---|
| 2,699,321 | 1/1955 | Nelson | 175/8 |
| 4,217,848 | 8/1980 | Meyer-Haake | 114/264 |
| 4,295,758 | 10/1981 | Yashima | 405/211 X |
| 4,343,055 | 8/1982 | Bergling | 114/264 X |
| 4,502,551 | 3/1985 | Rule et al. | 175/8 X |
| 4,657,439 | 4/1987 | Petersen | 405/200 |
| 4,702,321 | 10/1987 | Horton | 166/350 |
| 4,735,267 | 4/1988 | Stevens | 405/224 X |

*Primary Examiner*—David H. Corbin
*Attorney, Agent, or Firm*—Keaty & Keaty

[57] ABSTRACT

A floating drilling and production unit comprising two independently floating bodies: (1) an outer, larger, substantially cylindrical buoyant caisson with an enlarged skirt wellhead buoy captured within the central well of the outer caisson. The outer caison supports the weight of the drilling platform, machinery, storage and living quarters and is ballasted and anchored in a manner similar to a conventional semisubmersible vessel. The constant tension buoy supports the wellheads of completed wells and is held in a constant position relative to the ocean floor much like a tension leg platform by the production risers of completed wells, tendons, or a combination of tendons and risers. Production risers are kept taut by the buoyancy of the constant tension buoy. The constant tension buoy has a tapered shape that minimizes contact and interaction between the wellhead buoy and the caisson. Thus, the wellhead buoy is substantially unaffected by sea-induced motions of the bouyant caisson. Drilling operations with equipment supported by the caisson are carried out through a moonpool extending vertically through the wellhead buoy.

23 Claims, 3 Drawing Sheets

SEMISUBMERSIBLE VESSEL WITH CAPTURED CONSTANT TENSION BUOY

BACKGROUND OF THE INVENTION

This invention relates to a novel form of semisubmersible oil and gas production and drilling vessel which comprises an outer production and drilling semi-submersible vessel completely surrounding an independently floating wellhead support buoy.

The first offshore oil wells were simply wells drilled from piers extended out into the water. In later years, the search for oil and gas further away from shore led to the development of freestanding offshore platforms and submersible barges. The drilling operations of these fixed platforms and submersible barges are similar to that of land operations: Wells are completed above the surface and wellheads are located on the platform. Conventional land drilling equipment is commonly used. In deep water, fixed platforms and submersibles become uneconomical with increasing water depth, since the supporting structure on these types of rigs must extend all the way to the ocean floor. In very deep water, construction costs for fixed platforms becomes astronomic. The need for oil and gas production and drilling in deeper waters has led to the development of floating drilling and production vessels such as drilling ships and semisubmersible drilling units. These floating drilling units are towed or moved under their own power to the well location and are positioned and secured by anchors and chains or wire ropes or by means of a dynamic positioning system. A drillship is simply an adaptation of a standard seagoing monohull ship with a moon pool or other means for carrying out drilling operations. A drillship has well-known advantages of mobility and high storage capacity. A drillship can generally travel at a relatively high speed and can fit through narrow passageways such as the Panama Canal so it can travel easily from its construction site to a distant offshore location. Also a drillship has a relatively high storage or payload capacity. The disadvantage of a drillship is that it has a long narrow hull and an extremely large water plane which, as is well known, makes it sensitive to wave action and storm sea conditions and subject to a large degree of pitch, roll and heave. During drilling operations, a floating vessel is connected to the seabed by a riser and the drillstring must be kept in contact with the bottom of the bore hole. Roll, pitch and heave motions make it difficult to maintain a drilling posture as the vessel would always be moving with respect to the ocean floor. Therefore, drillships work best in protected waters and during seasons when the sea is calm and generally are not useful in severe environments such as locations exposed to hurricanes or Arctic storms.

In response to the need for the development of offshore petroleum exploration and development in deep water where hostile sea conditions might be encountered, the semisubmersible drilling vessel was developed. The semisubmersible vessel substantially comprises a submerged base which most commonly consists of a pair of submerged hulls or pontoons. A series of vertical buoyant columns rise from the submerged base and support a horizontal deck or platform. The platform or deck is located far above the water line well above normal expected wave crests of giant ocean waves. This platform holds the living quarters, storage space for machinery and production equipment. Supported by the main deck is the cellar deck which provides for storage of subsea equipment and a substructure and drill floor upon which the draw works, rotary and derrick are mounted. Drilling operations are carried out through a moonpool through the cellar deck and main deck. The moonpool is generally located near the geometric center of the semisubmersible rig to minimize disruptions on the drilling operations caused by roll and pitch of the platform. A semisubmersible vessel is generally outfitted with extensive ballasting systems so that it can be transported to a drilling location in a low draft condition and then ballasted to a high draft condition for carrying out drilling operations. Recent advances in the understanding of hydrodynamics and the relationship between geometric hull configurations and vessel stability have led to the development of semisubmersibles with extremely reduced sensitivity to roll, pitch and heave motions so that drilling operations can be carried out with a minimum of down time due to rough seas and bad weather conditions. An example of such a stable semisubmersible drilling vessel is shown in U.S. Pat. No. 4,646,672.

The major disadvantages of semisubmersible drilling and production rigs as they are now known and used is their limited storage capacity and higher construction costs. The variable deckload capacity and crude oil storage capacity of a semisubmersible is relatively limited due to its open geometric configuration. Extensive ballasting systems capable of shifting ballast rapidly to maintain proper trim and of deballasting or ballasting as cargo is loaded or offloaded is required. Further, because the semisubmersible vessel as currently known and used comprises specially constructed hulls or pontoons held together by massive tubular bracings, fabrication costs of a semisubmersible vessel tend to be higher than standard ship construction.

Concurrent with the development of floating drilling vessels has come the development of equipment, methods and techniques for completing, producing and maintaining wells on the ocean floor. Commonly, complex multiwell systems are installed on the ocean floor with remotely controlled hydraulic and electronic control systems. Installation and maintenance of subsea wellhead equipment and expensive control equipment increases the cost of offshore production and often requires the extensive use of divers and diving operations and more complex remote control equipment to position and set the numerous valves of the wellhead assemblies and to conduct the periodic function and pressure testing of the wellheads. Placing wellhead assemblies on the sea floor makes routine inspection and maintenance more difficult and costly. Moreover, it requires the running of temporary risers for routine workovers. On a floating platform, completion of a well and installation of the wellhead above the surface is not practical because the production riser that connects the subsea wellhead with the above the surface wellhead assembly can be easily damaged. With drilling operations, mechanisms such as a riser slip joint, riser and guideline tensioners and a drillstring motion compensator have been developed to maintain a constant pressure on the drill bit so that drilling is not hampered by vessel motion. With production operations, a rigid connection from the wellhead to the floating vessel subject to even minimal roll, pitch and heave presents many problems not yet solved by proven technology. A production riser must stay in place for several years while oil is being produced from the well and motions of a floating vessel can over time create fatigue in the production riser and possibly lead to failure. Usually what is done therefore, is to install a wellhead assembly on the ocean floor and connect the ocean floor wellhead assembly to a floating vessel or a subsea pipeline with flexible flow lines.

Related art shows the development of floating drilling production and oil storage vessels that comprise extremely deep draft caissons or elongated buoys that minimize wave motion sensitivity and provide a stable platform by locating the bottom of the vessel far below the surface of the water.

U.S. Pat. No. 4,606,673 shows a spar buoy construction for a floating deep water production and oil storage. The vessel includes a riser system whereby risers are connected to a riser float chamber that moves along guides within a vertical passageway within the vessel. Adjustable connections for each riser ensure that all risers are under equal tension. The buoyancy chamber is totally submerged in operation and is held at a selected constant height above the sea bed. This vessel does not have a moon pool and is not designed for drilling or extensive workover operations.

U.S. Pat. No. 4,702,321 shows a deep draft caisson (700 to 800 feet draft) with a center well for conducting drilling operations. Each individual riser is connected to a separate buoyant means within the upper portion of the central well.

A recently developed alternative to the floating drilling and production vessel is the tension leg platform, which comprises a light buoyant platform anchored to the seabed by vertical tendons that are kept taut by excess buoyancy of the hull. The anchor lines consist of parallel or substantially parallel vertical tendons that are under high tension so that the platform is not affected by wave motions and maintains a fixed position relative to the ocean floor. It is thus relatively free from the heaving, rolling and pitching motions that a conventionally anchored floating vessel encounters. Various tension leg platforms are disclosed in U.S. Pat. Nos. 4,468,157, 4,620,820 and 4,664,554. Because the platform maintains a fixed position relative to the ocean floor, it is often possible to install wellhead assemblies on the platform above the water surface so that the numerous valves and gauges of the wellhead can be easily set in position and that periodic function and pressure testing can be carried out easily and so that the wellhead assemblies are close to vital high pressure and control equipment.

A major drawback to the tension leg platform as currently developed is that the vessel's cost increases tremendously as the vessel payload increases. An increased payload directly affects buoyancy requirements which in turn increases tendon and foundation requirements. A heavier platform with complete production, drilling and storage facilities requires a larger vessel to maintain buoyancy and a stronger foundation and tendons to hold the vessel in place. Vessel payload can be a critical factor in designing a vessel for operation in remote waters where there is not an easy access to supply ships for delivering fuel, water and drilling fluids and tankers for removing oil production.

SUMMARY OF THE INVENTION

It is the purpose of this invention to provide a new form of drilling production and oil storage vessel comprising two independently floating bodies: (1) an outer, larger, substantially cylindrical caisson with an enlarged buoyant skirt around its lower perimeter, a vessel that has a steadiness with respect to wave motions that is equal to or better than a conventional semi-submersible drilling platform and an inner wellhead buoy that maintains a constant position relative to the ocean floor in a manner similar to a tension leg platform. The larger unit, the production drilling vessel, bears the heavy load of the drilling platform, equipment, personnel and oil storage. It is towed to the well location and is positioned, ballasted and anchored much like a conventional semi-submersible vessel. Captured within the central vertical well of the larger unit is the second unit, the constant tension buoy, which supports the wellhead assemblies of completed wells and the production manifold. The constant tension buoy is held in a constant position relative to the ocean floor by "tenductors", essentially vertical tubular members, such as tendons, well risers, or conductors that are connected to the ocean floor, and serve as mooring lines. The constant tension buoy has a central well through which drilling, with equipment whose weight is supported solely by the production drilling vessel or caisson, takes place. Thus, the constant tension buoy functions much like a tension leg platform, except that since it carries only the wellheads and does not have to support the drilling equipment and supplies, it does not need the elaborate, expensive foundations and tendons that a tension leg platform requires for stability and station keeping. The well risers alone are sufficient to keep the constant tension buoy in place. The constant tension buoy, which is free to move within the well of the production drilling vessel, is virtually unaffected by roll, pitch, yaw, or heave motions of the production drilling vessel that could damage the well risers and maintains a constant position relative to the ocean floor, except for some lateral movement. Lateral excursion of the drilling production vessel is minimized by its catenary anchoring system. The constant tension buoy has an upper frustoconically-shaped portion and a lower portion in the shape of an inverted truncated cone, connected to the base of the upper portion at its own base. The lower portion of the buoy provides sufficient buoyancy for tension of riser lines. The tension of riser lines is maintained through retaining a controlled amount of ballast in the chambers of the hull of the constant tension buoy. Substantially the entire payload of well drilling, production and storage facilities is carried by the buoyant caisson.

The buoyant caisson is substantially cylindrical or symmetrical in shape so that it is stable with respect to seas from all directions. Stability of the vessel is further enhanced by a buoyant or non-buoyant skirt or shelf around the lower perimeter of the buoyant caisson.

It is thus an object of this invention to provide a revised geometric form for a semisubmersible drilling and production vessel with significantly reduced sensitivity to wave motion effects in any direction in sea states commonly encountered during drilling and production operations.

It is further an object of this invention to provide a drilling and production vessel with increased storage space for water, fuel, and other supplies and especially for large amounts of crude oil produced by the vessel.

It is further the object of this invention to provide a floating drilling, production and oil storage vessel that allows the completion of wellheads above the water surface.

It is a further object of this invention to provide a semi-submersible vessel which provides stability for above the surface wellheads and production risers by supporting the wellhead assemblies in a floating wellhead buoy unit independent from and captured within the well of a larger production drilling unit and fastened to the sea floor by tendons, well conductors, or a combination of tendons and well conductors such that the wellhead buoy is kept in a constant position relative to the ocean floor and is not affected by roll, pitch, yaw or heave of the production drilling unit. Constant tension is maintained on production risers at all times so they are not weakened by compression fatigue or rhythmic motions of an anchored floating vessel in response to sea conditions.

It is a further object of this invention to provide for extraordinary protection for production risers connecting the wellhead buoy with the sea floor and for wellhead assemblies from damage due to other vessels and floating objects by surrounding them with a large heavy outer caisson secured by anchors to the sea floor and by surrounding the wellhead buoy with an annular bumper to absorb shock caused by impact with the large outer caisson.

These and other objects and features of the present invention will be more apparent from the following description of the preferred embodiment of the invention.

DETAILED DESCRIPTION OF THE PREFERRED EMBODIMENT

Figure 1:
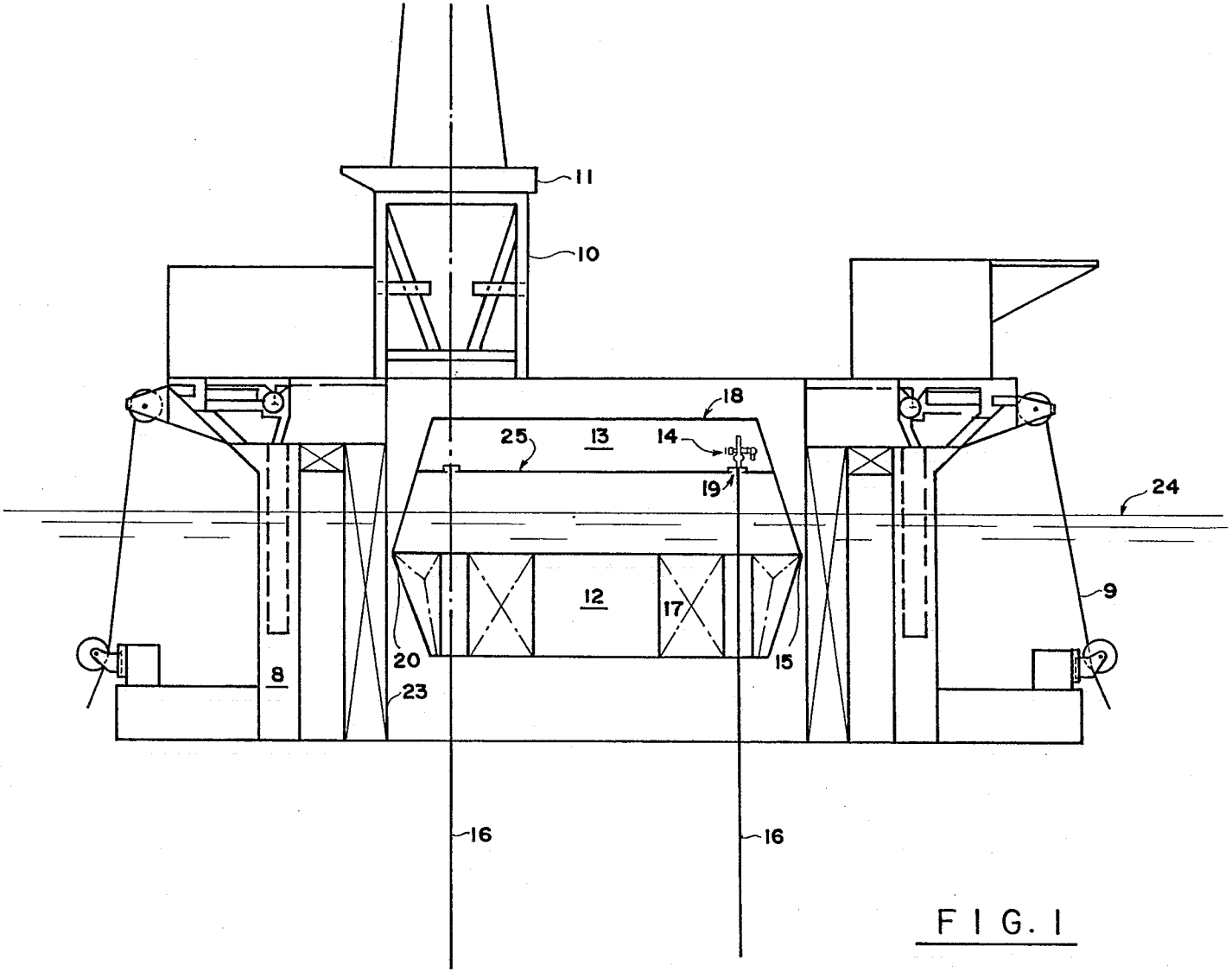
FIG. 1 is a cross-sectional schematic view of the preferred embodiment of the apparatus of the present invention.
Figure 2:
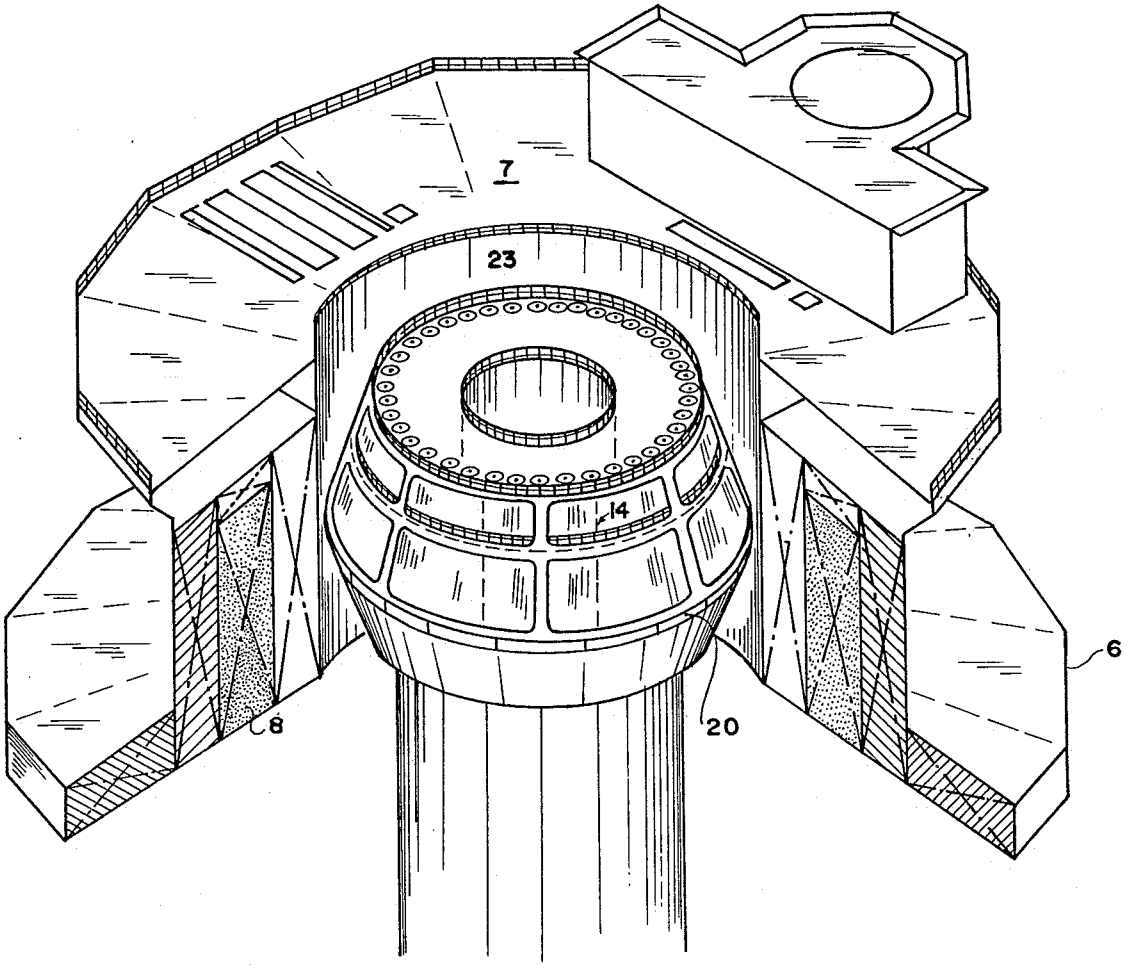
FIG. 2 is a perspective, partially cut-away view of the preferred embodiment of the apparatus of the present invention.
Figure 3:
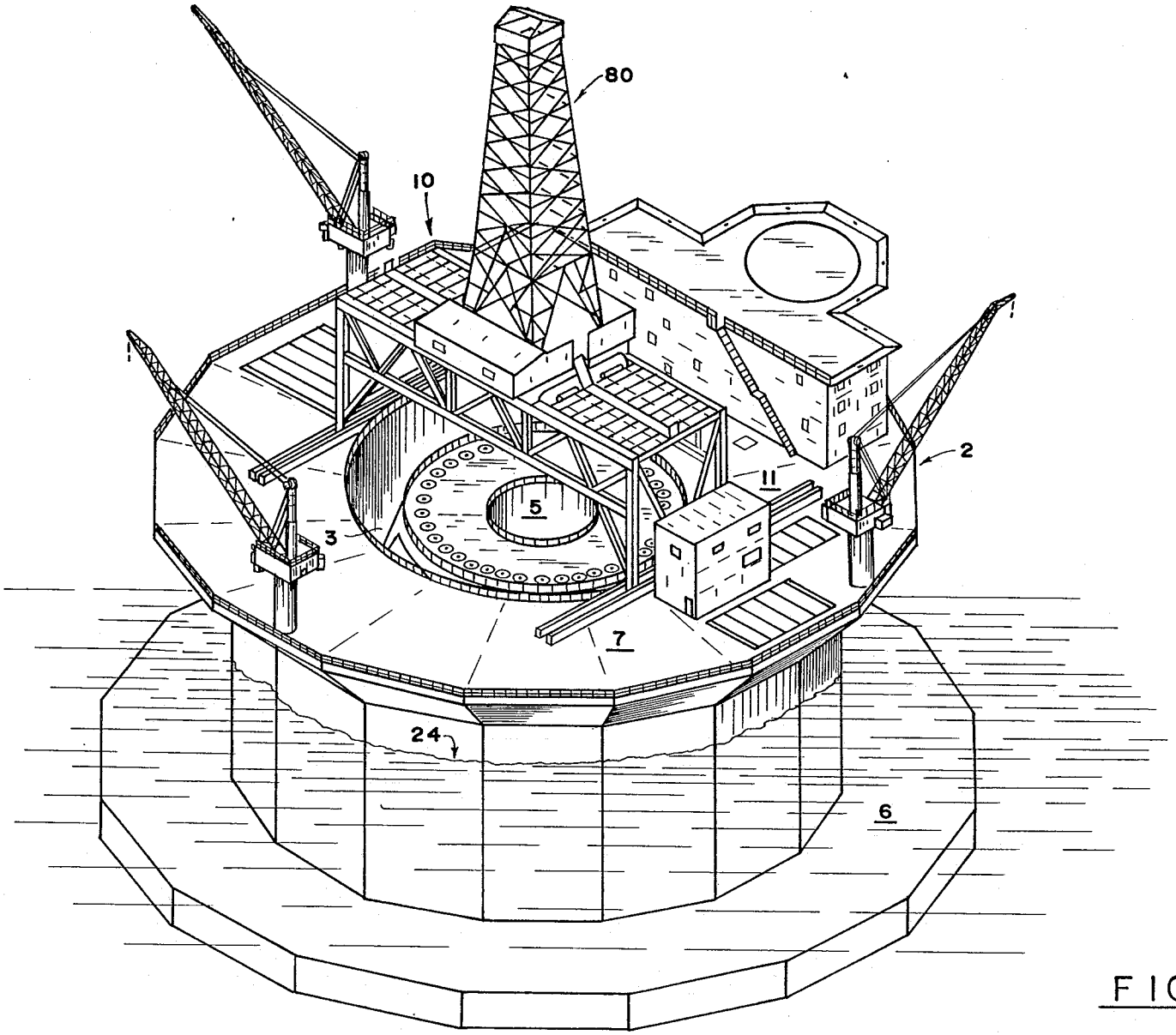
FIG. 3 is a perspective view of the preferred embodiment of the apparatus of the present invention.

FIGS. 1, 2 and 3 show one of the preferred embodiments for the floating production and drilling unit. As shown in FIGS. 1, 2 and 3, the semisubmersible vessel comprises a single caisson 2 with a center moonpool 3 having a substantially cylindrical wall 23. Captured entirely within the center moonpool 3 is the wellhead buoy or constant tension buoy 4 which in turn has its own central moonpool 5, through which the drilling operations are conducted.

The geometry of the buoyant cassion 2, as shown, is that of a sixteen sided regular polygon approximating a circle in its cross section with an exemplary outside diameter of 150–500 feet and an inside diameter of 40–150 feet. The polygonal shape of the caisson allows for the fabrication costs of the vessel to be minimized, since it allows a great amount of structural redundancy, the use of flat steel plate, and a minimum of shaping. However, the hull may be of any suitable size and shape including cylindrical, elliptical, or a series of flat adjoining plates. The bottom portion of the caisson hull is enlarged in diameter to form a buoyant or non-buoyant skirt 6 which improves steadiness by dampening sea induced motions. The skirt 6 is rigidly attached to the lower portion of the caisson 2 perpendicularly thereto. The buoyant skirt or shelf may be substantially cylindrical in shape or may be elongated to permit easier towing of the vessel from one site to another. The hull form of this type particularly with the substantially cylindrical caisson is found to be steadier with respect to rough seas from all directions and provides lower response to heave, roll and pitch than a conventional semisubmersible vessel. The caisson hull provides ample enclosed space 8 which can be subdivided into numerous tanks for ballast, fresh water, fuel oil and provides additional space so that up to approximately 185,000 barrels of crude oil can be temporarily stored on board. This reduces the need for frequent visits by a shuttle tanker which can result in great cost savings for a vessel that is operating in a remote area. Oil can be exported from the caisson 2 by means of a floating hose (not shown) to a tanker, mooring buoy or can pass directly to a subsea pipeline. Further, the increased volume of storage space in the caisson for fuel, water and drilling fluid reduces the need for visits by supply vessels in comparison to a conventional semisubmersible vessel which has a more limited storage area. The storage area will also contain ballast tanks which can be flooded or emptied as is well known in order to raise or lower the vessel consistent with the overall operational needs of the vessel.

When the vessel is being transported from one location to another, the ballast tanks are emptied so that the vessel is raised to a floating condition for easier transportation. If the vessel encounters storm conditions while it is being towed, the caisson can be ballasted so that the vessel can ride out the storm in its deep draft operational posture wherein it has the maximum stability and is least subject to wind and rolling/pitching action of the sea. After the storm passes, water is pumped out so that the vessel returns to its towing draft. As will be described below, the wellhead buoy can also be selectively ballasted to maintain the buoyancy required for drilling operations, towing, or riding out storm conditions.

The working deck or main deck 7 is supported by the upper part of the caisson at an adequate height above the sea level so that there is virtually no probability that waves can hit the upper deck in storm conditions or wave conditions likely to be encountered. The main deck 7 supports crew accomodations, well drilling equipment, oil and gas processing machinery, and pipe storage areas.

Straddling the center moon pool 3 is a sliding substructure 10 that slides in a forward and aft direction approximately atop the main deck 7 using skidding systems similar to those used on jackup rigs. The sliding substructure 10 supports the cellar deck 11 which includes conventional retractable spider beams which support the blowout preventor (BOP) stack and other associated equipment during riser stab-in or well completion operations. The cellar deck 11 is elevated above the main deck 7 to provide sufficient clearance between the deck 11 and the wellhead buoy 4 so that there is substantially no danger of collision between the top of the wellhead buoy and the cellar deck during storm conditions. There should also be sufficient clearance between the caisson substructure 10 and both the wellhead buoy 4 and the main deck 7 to allow removal of BOP equipment or wellheads during major maintenance. Atop the substructure 10 is the drill floor which supports the drilling rig which comprises a derrick 80. The drill floor 11 is adapted for sliding movement so it can be skid in the port or starboard direction. With the combination of forward and aft sliding capability of the substructure and port and starboard sliding capability of the drillfloor, the derrick 80 can be positioned at substantially any location over the wellhead buoy moonpool 5 for conducting drilling operations through the moonpool or can be slid into position above individual well bays of the central wellhead buoy for the running of production risers, the completing, and workover of wells. The substructure 10 includes dual pipe racks and dragways so that risers and tubulars can be fed to the drill floor from either side during the drilling operation. The substructure 10 and drill floor 11 remain on the caisson after all of the wells are drilled to provide workover services. The double skidding feature of the substructure and drill floor in combination allow each well of the wellhead buoy 5 to be reached by either a wireline unit mounted on the cellar deck or by major workover equipment on the drill floor.

At a production and drilling location, the caisson is moored by a conventional catenary mooring system using flexible lines 9 such as for example, a chain or wire and chain combination similar to what is used on a conventional semisubmersible drilling rig. Where a caisson with the sixteen sided cylindrical configuration is used, a sixteen point combination spread flexible mooring system could easily be incorporated, although any suitable spread mooring pattern or mooring system designed to fit the vessel and particular environmental conditions anticipated at the site may be used. The caisson 2 is substantially free to move in all directions within the restraints of the mooring system although it is anticipated that because of the stable design of the vessel, motions of the vessel such as roll, pitch and heave in response to environmental conditions will be minimal.

The captured wellhead buoy 4 comprises an independently floating body captured within the moonpool 3 of the buoyant caisson 2. The wellhead buoy provides structural support for the wellhead assemblies 14 or christmas trees and is vertically moored in a constant position with respect to the seabed by risers. As will be shown below, the captured wellhead buoy 4 is substantially unaffected by roll, pitch, yaw or heave motions of the caisson 2 or by seaway induced forces on the buoy. Further, the vital production lines or risers are protected from open sea collisions with other vessels and floating objects by the surrounding caisson.

The captured wellhead buoy 4 comprises two parts: a buoyant lower portion 12 which is mostly, if not entirely, under water when in working position, and an upper portion 13 which is essentially nonbuoyant. The lower portion provides sufficient buoyancy to maintain constant tension on the riser lines 16. This is especially important since riser lines, as is well known, are susceptible to damage from compression loading so that any downward pressure on riser lines could cause fatigue and bending stresses which would be unacceptable. Therefore, the wellhead buoy must maintain a constant upward net force on the riser lines at all times. The bottom portion 12 of the wellhead buoy 4 comprises many compartments 17 that allow variable saltwater ballasts so that a predetermined amount of tension can be maintained on the risers 16 at all times during installations and production operations. The lower ends of the rigid riser 16 are attached to subsea wellheads by means of hydraulic wellhead connectors and tapered joints which are known in existing technology (not shown).

The upper portion 13 of the wellhead buoy 4 provides structural support for wellhead assemblies 14 or christmas trees. The upper portion 13 of the buoy will be substantially above the water line 24 within the central well 3 of the caisson 2 during all phases of production operations of the vessel, which water line is substantially the same as the water line on the exterior of the vessel. The upper portion 13 of the buoy comprises a tree deck level 25 where the upper ends of the risers 16 attach to the wellhead buoy 4 by means of lockdown screws 19. The mechanical lockdown screws permit each riser length to be adjusted to compensate for variations in the seabed and riser length due to temperature and pressure differentials. Fixed platform type wellhead assemblies 14 or christmas trees sit atop the risers 16. Jumper hoses or loading arms connect each wellhead assembly 14 to ring type production annulus and test manifolds (not shown) located atop the tree deck 25. These manifolds are, in turn, connected to the caisson 4 with flexible hoses which permit movement between the buoy 4 and caisson 2 without affecting the flow.

Above the tree deck 25 on the wellhead buoy 4 is a protection deck 18 that substantially covers the area above the wellhead assemblies 14 and production manifolds. Drilling operations of some remaining wells will take place at the same time that some completed wells are put into production, so the protection deck 18 serves to protect the wellhead assemblies of completed wells 14 and the production manifolds from objects such as drilling pipe, subsea equipment or tools that might be accidentally dropped from the drill floor, cellar deck, or main deck. Access from the drill floor and cellar deck to the individual well bays for the installation of production risers or, later on, wireline units or workover rigs is provided by openings in the protection deck.

The wellhead buoy 4 is designed so that in its excursion within the central moonpool 3 of the caisson buoy 2, interactions between the wellhead buoy 4 and the caisson 2 are substantially minimized. This is accomplished by means of a wellhead buoy wherein the upper 13 and lower 12 portions of the buoy 4 have frustoconical shapes joined together at or near their bases. The diamter of the buoy 4 at its widest point 15 has a diameter that is slightly smaller than the diameter of the central well 3 of the outer caisson 2. From this widest point 15, which during normal operations of the vessel will be below the water line 24, the buoy 4 tapers up at approximately 17° to a smaller diameter at the level of the protection deck 18 and tapers down at approximately 20° to a smaller diameter at the bottom of the lower portion of the buoy 4, although such shape is exemplary and many other degrees of tapering can be employed. Thus, the sides of the buoy 4 taper away from contact with the walls of the central moonpool of the caisson 2 so that the buoy 4 contacts the central well 3 of the outer caisson 2 only at the buoy's widest point 15 at any given time. Therefore, angular roll and pitch motion of the caisson 2 is not transferred to the wellhead buoy 4 and the wellhead buoy 4 keeps its same fixed orientation with respect to the ocean floor regardless of the roll and pitch of the caisson. The wellhead buoy 4 is substantially not affected by wave motions that vary the position of the caisson or by tilting or movement of the caisson. Moreover, because there is minimal contact between the wellhead buoy 4 and the caisson 2 yaw motions of the caisson 2 which could be caused by wind or water action or by collision with a vessel will not impart torque to the wellhead buoy so that the wellhead buoy stays in the same rotational orientation with respect to the seafloor. Lateral motion such as surge and sway in response to wind and current conditions will impart lateral motion to the caisson within the restraints of the catenary mooring system. To the extent that lateral motion of the wellhead buoy is constrained by the production risers, lateral motion of the caisson 2 causes the buoy to be drawn downward in the caisson moonpool 3. The caisson moonpool 3 will be of sufficient depth to provide an adequate margin between the bottom portion of the caisson moonpool and the bearing surface 15 of the wellhead buoy 4 so that the wellhead buoy 4 cannot be pulled out from under the caisson during substantially any surge, roll, pitch, heave or sway inducing conditions such as hurricane storms. The risers 16 are centralized at the level of contact 15 between the buoy 4 and the caisson 2, so that when the buoy 4 bears against the moonpool bulkhead 23 of the caisson 2 in response to surge or sway of the caisson, the lateral force component of the riser tension in this deflected mode is applied at the same level as that of the caisson bearing force application. Should conditions dictate, a flexible joint (not shown) immediately below the level of contact would allow the risers 16 to rotate more freely at the centralizer (not shown) to insure that the load is applied uniformly to all risers. The centralizer and flexible joint work together to eliminate rotational moments in the buoy 4 which could cause an increase in tension in one riser 16 and a corresponding decrease in the diametrically opposite riser 16.

Interaction between the buoy 4 and the caisson 2 is minimized by a low friction annular polymer bumper 20 made up of known material which provides a near frictionless surface when exposed to seawater. The bumper would serve to absorb shock loads imparted by the caisson and to protect the bearing surfaces of the wellhead buoy 4 from damage due to shock imparted by its sudden movements with respect to the caisson in reaction to wave or wind action or minor collisions with tankers, supply vessels or other floating objects.

The vessel may be constructed with the wellhead buoy 4 contained inside the moonpool 3 and temporarily supported off the dock by temporary deck supports. As construction of the buoy and caisson proceeds, the buoy can be locked to the caisson by four rack chocks (not shown) at 90° points on the circumference of the buoy lateral bearing surface 15. These rack chocks are similar to those disclosed in U.S. Pat. No. RE32,589 issued on Feb. 2, 1988, the disclosure of which is incorporated herewith by reference. When temporary deck supports are removed, the entire weight of the buoy 4 is supported by the caisson 2 through the rack chocks. At this locked position, the buoy 4 is positioned somewhat lower than its stillwater operating position relative to the caisson 2.

If the unit is built in a remote location requiring an ocean transit, the caisson is wet-towed with its ballast tanks emptied to provide a relatively low draft condition or transported on a dry tow vessel if economics so dictate. The caisson can be variably ballasted before and after it is outfitted for drilling operations to maintain the optimum transportation draft. A portion of the wellhead buoy will be below the water surface during transportion so the buoy can also be ballasted to maintain an approximately neutral net buoyancy. As described above, the entire vessel can be ballasted to a high draft in the event the vessel encounters a hurricane while it is being towed. Then it can be deballasted back to a low draft after the storm passes.

When the vessel arrives at a location for drilling and production, the mooring chains 9 on board the caisson 2 are deployed, attached to predeployed mooring lines and pretensioned in a manner well known. While the caisson 2 is ballasted down, the wellhead buoy 4 is also ballasted to maintain a minimum load on the supporting rack chocks.

In connecting production risers to the wellhead buoy, consideration must be given at all times to maintaining a constant tension on the risers and to avoiding sudden jerking motions that can damage the risers. During installation of the first risers this is accomplished by a known technique using special risers with buoyancy cans which are self supported when the cans are evacuated by air. When each of the first risers are attached to the wellhead buoy, the substructure is skidded over the well to be attached and the production riser is run using the derrick. Tension on the riser is maintained by the combination of the blank seacans and the drillstring compensator while the top joints of the riser are being installed. The top joint of the production riser is threaded and the lockdown nut is screwed on before running of the top joint. Since the wellhead buoy while supported by rack chocks is positioned farther below the water line than it is during its operational posture when supported by risers, the lockdown nuts of these first production risers will be slightly above the tree deck while the wellhead buoy is still being held by the rack chocks. When the first production riser is in place, the substructure is then skidded over the next well and the same process of installing the top joints to the production riser while maintaining a constant tension by use of buoyancy cans and the drill string compensator is repeated. The process is then again repeated for the subsequent wells. When all of the initial risers are in place, supported by the buoyancy cans, the locknuts are positioned above the tree deck with sufficient clearance so that they are unaffected by heave and roll of the caisson/wellhead buoy. The ballast of the buoy is adjusted to assure neutral buoyancy, riser tensioner lines are attached to the buoy and activated to maintain tension on the buoy, and the rackchocks are pulled so that the buoy floats free up to its normal operating position. The buoy is then deballasted in steps while the riser buoyancy cans are flooded so that buoyant force on the risers is transferred from the buoyancy cans to the wellhead buoy. Care is taken to maintain a positive tension on the risers at all times. Then the wellhead buoy is deballasted until the risers have the desired tension at the lockdown nut and the buoyancy cans are completely flooded and can be removed. Once these first wells are completed and tied back to the wellhead buoy the wellhead buoy is free to float independently of the caisson as described above in this application. Production can then be carried out on the completed wells while the remaining wells are drilled. With the remaining wells, once each is drilled to their final depth, the drilling riser and BOP stack (not shown) are retrieved and stowed. The substructure 10 and drill floor 11 are skidded to their completion positions over the appropriate well bay. The production riser with a wellhead connector and tapered joint are run. When the wellhead connector is locked into the subsea wellhead, the drill string compensator is used to maintain tension on the riser 16 while the lockdown screw 19 is being engaged. Once again, there is a gradual process whereby the lockdown screw 19 slowly assumes the riser tension while the drill string compensator slowly lets up on tension so that a constant amount of positive tension is maintained on the production riser at all times. The wellhead buoy 4 is also deballasted to maintain the appropriate amount of tension on the production riser. Then the wellhead can be installed on top of the production tubing and the wellhead can be connected to the circular manifold and production from that well can begin. The substructure 10 and drill floor 11 are then returned to the drilling position and the next well begun. Thus, production of completed wells and drilling of new wells can be carried out at the same time.

Alternatively, the buoy may be held in place by temporary or permanent tendons so that wells may all be drilled from the caisson. These tendons may be replaced by tenductors when the wells are drilled at a later date. Should some operators not condone the use of tenductors, any combination of risers, tendons and/or tenductors may be employed to hold the buoy in position as may be required by the environment or the operator's preference.

While only preferred embodiment was described herein, it should be understood that the above description is illustrative only and not for the purpose of limiting the scope of protection of this invention. I, therefore, pray that my rights to the present invention be limited only by the scope of the appended claims.

I claim:

1. A semisubmersible vessel, comprising:

a buoyant caisson having a central well extending vertically therethrough; and a constant tension buoy captured inside said central well in the absence of rigid attachment of the buoy to caisson, said constant tension buoy being held in a fixed position relative to a floor of a body of water, wherein said caisson and said buoy are independently floating bodies during operation, said buoy having a diameter at least slightly smaller than a diameter of the central well and is shaped to accommodate an angular roll and pitch motion of the caisson, while preventing such motion from affecting the motions of the buoy, and wherein said buoy has an upper frustoconically-shaped portion and lower frustoconically-shaped portion, the upper and lower portions being connected to each other adjacent their respective bases, so that the buoy tapers upwardly and downwardly from a widest point.

2. The vessel of claim 1, wherein said constant tension buoy is substantially unaffected by wave conditions affecting the caisson surrounding the buoy.

3. The vessel of claim 1, wherein said caisson is provided with a center moonpool extending vertically through a hull of the buoy and allowing conducting of a well drilling operation.

4. The vessel of claim 1, wherein said caisson comprises means for damping wave induced motions.

5. The vessel of claim 4, wherein said means for damping wave induced motions comprises a peripheral skirt extending substantially perpendicularly to a lower end of the caisson and rigidly attached thereto.

6. The vessel of claim 1, wherein said caisson is adapted for flexible mooring to the floor of the body of water.

7. The vessel of claim 1, wherein said caisson is adapted to carry substantially entire payload of well drilling, production and storage facilities.

8. The vessel of claim 1, wherein said buoy comprises a deck, allowing completion of a well above a water surface.

9. The vessel of claim 1, wherein said buoy comprises an annular bumper means for protecting said buoy from loadings due to contact with a wall of said caisson central well at an interface of their respective bearing surfaces.

10. The vessel of claim 1, wherein said caisson has an exterior wall of polygonal cross-section approximating a circle, with the exterior wall being formed by a plurality of substantially flat plates joined together along their vertical edges.

11. The vessel of claim 1, wherein a vertical dimension of the buoy is substantially smaller than a vertical dimension of the caisson central well.

12. The vessel of claim 1, wherein said buoy is held in its constant position by at least one riser line fixedly connected to the floor of the body of water.

13. The vessel in claim 1, wherein said buoy is held in its fixed position by at least one tendon fixedly connected to the floor of the water.

14. The vessel in claim 1, wherein said buoy is held in its fixed position by any combination of riser line(s) and tendon(s) fixedly connected to the floor of the water.

15. The vessel of claim 12, further comprising means for maintaining a pre-determined amount of tension on a well conductor and/or tendon, said means comprising ballast means positioned in a hull of the buoy.

16. The vessel of claim 1, wherein a limited lateral movement of the buoy is operationally dependent upon its accompanying vertical downward movement due to its excursion with the caisson.

17. The vessel of claim 1, wherein the lower portion of the buoy provides sufficient buoyancy for tension of the well conductor and/or tendon.

18. The vessel of claim 1, wherein said caisson supports at least one deck means adjacent its upper part, the deck means carrying drilling and production facilities.

19. A semisubmersible vessel for conducting well drilling and production operations, comprising:

a single buoyant caisson having a central cylindrical well extending vertically therethrough;

a buoyant skirt attached to a lower portion of the caisson in substantially perpendicular relationship thereto;

at least one deck carried by an upper part of the caisson and adapted for supporting substantially entire payload of well drilling and production facilities; and a constant tension buoy captured inside said central well, floating independently from said caisson during operation and being held in a constant position relative to a floor of a body of water by tension means fixedly attached to the floor of the body of water and to deck of the constant tension buoy, wherein the constant tension buoy has a form and shape which permits rotational and vertical movement of the caisson about a roll center of the caisson and accommodates roll and pitch motion of the caisson without imposing such additional motions and forces into the buoy and the riser lines it supports, said buoy having a diameter at least slightly smaller than a diameter of the central well, and wherein said buoy has an upper frustoconically-shaped portion and a lower frustoconically-shaped portion, the lower and upper portions being connected to each other adjacent their respective bases, and wherein said buoy tapers upwardly and downwardly from a widest point.

20. The vessel of claim 19, wherein the constant tension buoy has a form which permits rotational movement of the caisson about a roll center of the caisson without imposing such additional motions and forces into the buoy and the riser lines it supports.

21. The vessel of claim 19, wherein the constant tension buoy has a form which permits vertical movement of the caisson about a roll center of the caisson without imposing such additional motions and forces into the buoy and the riser lines it supports.

22. The vessel of claim 19, wherein the constant tension buoy has a form which permits rotational and vertical movement of 23. The vessel of claim 21, wherein said ballast means comprise a plurality of ballast compartments formed in a hull of the buoy and housing a ballast media.

* * * * *